United States Patent [19]

Gibson

[11] 4,061,112

[45] Dec. 6, 1977

[54] STEAM GENERATING PLANT

[75] Inventor: Thomas Gibson, Potters Bar, England

[73] Assignee: Foster Wheeler Energy Corporation, Livingston, N.J.

[21] Appl. No.: 652,602

[22] Filed: Jan. 26, 1976

[30] Foreign Application Priority Data

Feb. 7, 1975 United Kingdom ..... 5357/75

[51] Int. Cl.[2] ..... F22B 1/02; F22B 21/22

[52] U.S. Cl. ..... 122/7 R; 122/235 R

[58] Field of Search ..... 122/7 R, 7 A, 7 B, 7 C, 122/7 D, 336, 235 R

[56] References Cited

U.S. PATENT DOCUMENTS

| | | | |
|---|---|---|---|
| 2,754,807 | 7/1956 | Smith | 122/7 |
| 3,136,298 | 6/1964 | Frendberg et al. | 122/336 |
| 3,254,634 | 6/1966 | Vorkauf | 122/7 |
| 3,269,360 | 8/1966 | Adams | 122/7 |
| 3,815,882 | 6/1974 | Regan | 122/7 |
| 3,858,556 | 1/1975 | Terentier et al. | 122/7 |

*Primary Examiner*—Kenneth W. Sprague

*Attorney, Agent, or Firm*—Marvin A. Naigur; John E. Wilson

[57] ABSTRACT

This invention relates to waste heat steam boiler plant and in particular to a transition chamber for joining a waste heat gas duct to a waste heat boiler in such plant. The cross-section of the boiler inlet differs from that of the waste gas duct and so this transition chamber has a cross-section which progressively joins one to the other. Instead of using refractory clad steel the chamber is made according to the invention from air-tight water cooled tube panels formed of tubes joined by fins.

3 Claims, 3 Drawing Figures

STEAM GENERATING PLANT

This invention relates to the generation of steam from hot waste gases. In particular the invention relates to a waste heat steam generation plant.

BACKGROUND OF THE INVENTION

With wast heat boilers there is usually a difference in gas flow cross-sectional areas as between the waste gas duct and the boiler inlet duct. Therefore the two must be joined by an expanding transition chamber.

This transition chamber can comprise a steel casing to contain the gas pressure and lined with refractory material to keep the steel casing at an acceptable metal temperature. This design has many disadvantages, particularly at high gas temperatures. Some of its disadvantages are the need for a high degree of maintenance of the refractory, the possibility of the refractory breaking away and exposing the steel shell to hot gases and the possibility of the refractory cracking and allowing hot gases to condense on the casing thus leading to corrosion.

The invention has therefore been made with these problems in mind and so it is an object of the invention to provide a transition chamber and waste heat plant where these problems are avoided.

BRIEF SUMMARY OF THE INVENTION

According to the invention there is provided waste heat steam boiler plant comprising a waste heat boiler and a transition chamber to be connected to a waste gas duct to lead the waste gases from that duct to the boiler, the walls of the transition chamber being defined by air-tight, water cooled tube panels formed of tubes joined by fins.

Also according to the invention there is provided a transition chamber for joining a waste gas duct to a waste heat boiler, the chamber having a cross-section which changes progressively from its inlet to its outlet and its wall being defined by air-tight, water cooled tube panels formed of tubes joined by fins.

Since this transition chamber need not have a refractory lining, problems associated with the use of a refractory are avoided. Also the water cooling keeps the walls of the chamber at a reasonable temperature and prevents over-heating. This chamber could also act as a furnace for the waste heat boiler, suitable provision for burners being made in the walls, and so supplementary fuel could be burnt in this chamber in the event of extra heat over and above the heat content of the waste gas being required.

The tubes forming the walls of the transition chamber can conveniently be supplied with water from that circulating within the waste heat boiler, steam produced or the heated water being returned to that boiler. Thus, for example, the tubes forming the walls of the transition chamber can be linked to the steam and water drum of the waste heat boiler.

Preferably at least some of the tubes forming the roof, side walls and floor of the transition chamber extend from the roof, through a side wall and into the floor. Each side wall will still normally require extra tubes and these extra tubes preferably extend within the chamber parallel to the tubes in the roof, through the side wall and within the chamber parallel to the tubes in the floor. It is further preferred that at least some of the tubes extending through the roof and floor pass, not through a side wall, but instead form a tube screen extending across the waste gas inlet to the chamber. These tubes can then act as flow straighteners.

BRIEF DESCRIPTION OF THE DRAWINGS

The invention will now be described, by way of example, with reference to the accompanying drawings, in which.

DESCRIPTION OF THE PREFFERED EMBODIMENT

Figure 1:
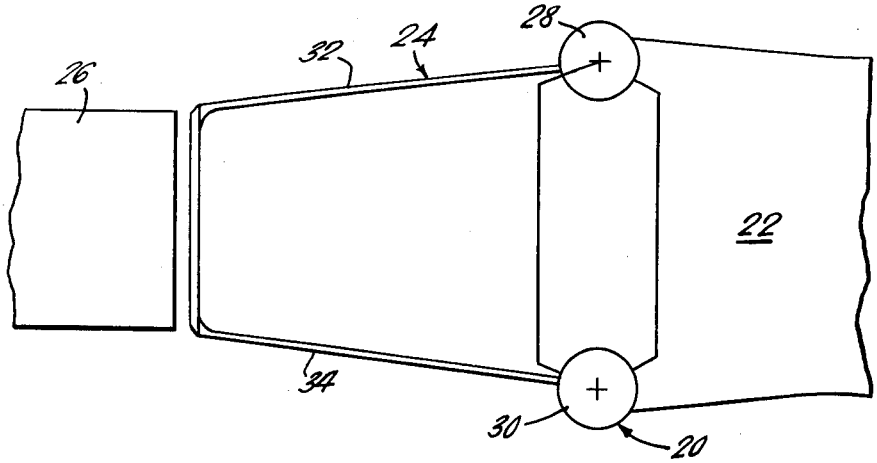
FIG. 1 is a sectional side elevation of waste heat plant according to the invention.
Figure 2:
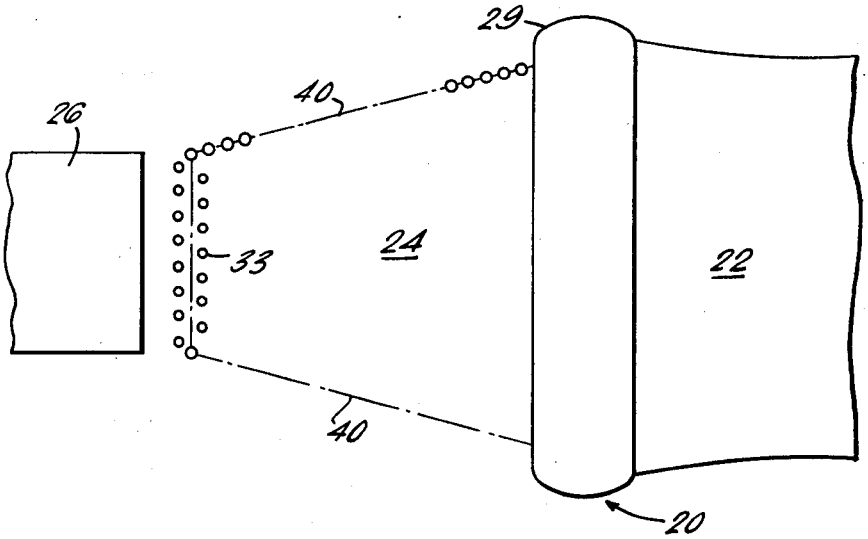
FIG. 2 is a plan view of that part of the waste heat plant.

The waste heat plant 20 shown in FIGS. 1 and 2 includes a waste heat steam boiler 22 and a transtion chamber 24. This chamber joins the end of a waste gas duct 26 to the boiler 22. The latter can be entirely conventional and so will not be described in detail. It has an upper steam drum 28 and a lower steam and water drum 30.

Because the cross-sectional area of the boiler 20 is much greater than that of the duct 26, the roof 32, floor 34 and side walls 40 of the transition chamber all taper in the direction from the boiler to the duct 26.

Tubes 29 are taken from the drum 28 and formed into part of an impervious fin tube panel by joining adjacent tubes with fins, this panel serving as the roof 32 of the transition chamber 24. This impervious fin tube panel extends to the front left hand end as viewed in FIGS. 1 and 2, of the transition chamber where the waste gases enter from the duct 26. Then the tubes pass down in staggered formation 6 to form a screen 33 through which the waste gases enter. This screen also acts as flow straightener. At the bottom of the screen, the tubes are bent back to form another impervious fin tube panel which serves as the floor 34. Thereafter the tubes are joined to the lower drum 30.

Figure 3:
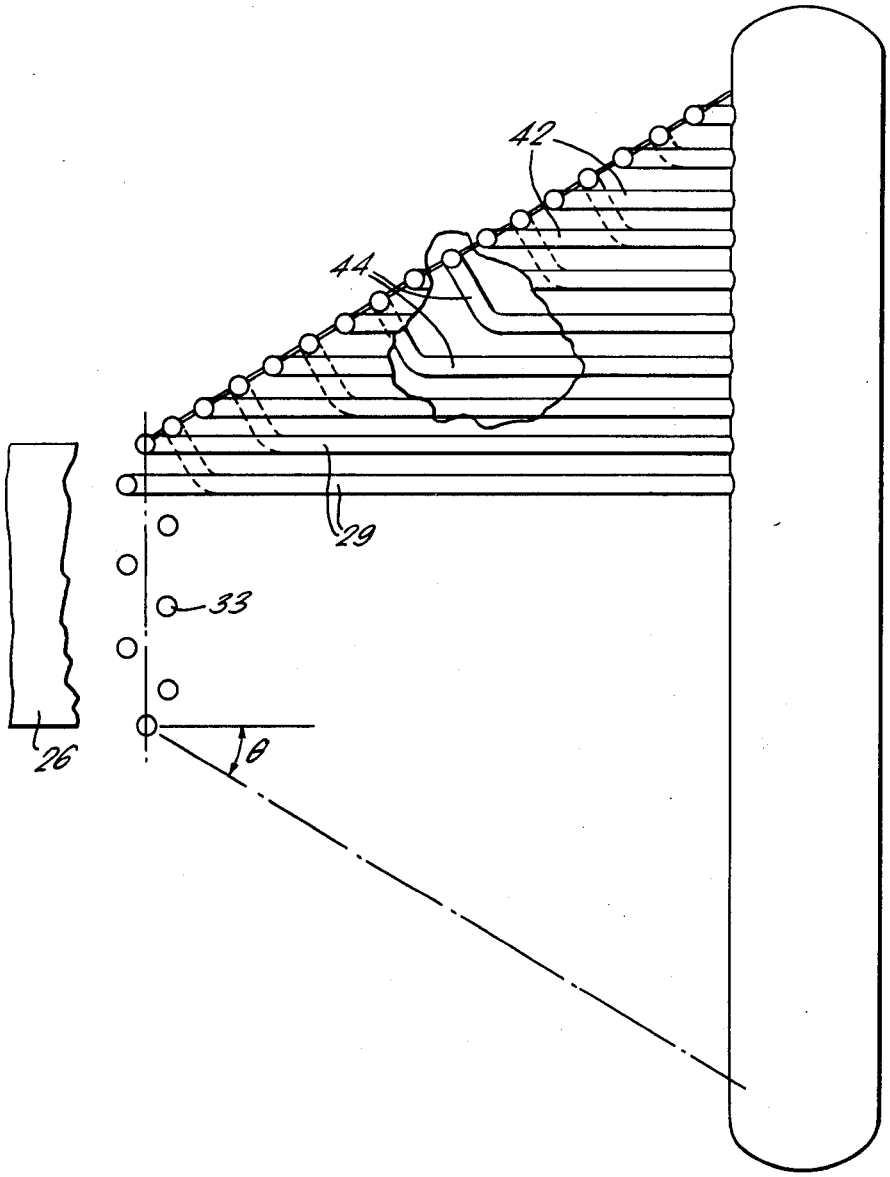
FIG. 3 is a plan view similar to FIG. 2 but showing the transition chamber in more detail.

The upright side walls 40 of the chamber are also in the form of an impervious tube panel formed of tubes joined by fins. The tubes in the panels forming the side walls have the same diameter and pitch as those constituting the roof and floor. When the tubes join the roof and floor they are bent into alignment therewith and a proportion 42 as shown in FIG. 3 forms the remaining triangular portions of the panel forming the roof 32 and the floor 34. The remainder of the side wall tubes 44 are taken individually and rooted parallel to the roof and floor under the roof tube line and above the floor tube line, and hence into the drum 28 or 30.

The precise proportion of side wall tubes which also form the roof and floor depends upon the angle $\theta$ (FIG. 3), which in turn depends upon the difference in cross-sectional area between waste gas duct 26 and boiler inlet duct. The approximate proportion of side wall tubes forming the roof and floor is given by sin $\theta$, e.g. if $\theta$ is 30° every other tube is taken to form the roof and floor.

In this manner, any angle of transition can be achieved, depending on the relative dimensions of the waste gas duct and boiler inlet duct, and on the proportion of side wall tubes taken to form the impervious roof and floor.

As can be seen, the intermediate chamber does not need refractory, and it is kept cool by the water tubes. If required an auxilliary burner can be positioned through one wall of the chamber 24 to burn supplementary fuel, the chamber then serving as the furnace of the boiler 22.

While the terms water and steam have been used herein, they are to be construed as meaning any suitable liquid and its vapour unless the context specifically requires otherwise.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What I claim is:

1. In a waste heat steam boiler plant:

a. A waste heat boiler comprising:

i. a steam drum adjacent to the top of said boiler;

ii. a steam and water drum adjacent to the bottom of said boiler;

iii. downcomer means connecting said steam drum to said steam and water drum; and iv. riser means connecting said steam and water drum to said steam drum;

b. a waste gas duct; and c. a tapered transition chamber adapted to be connected between said duct and said boiler, said transition chamber having a roof sloping upwardly from said duct, a floor sloping downwardly from said duct, and angularly disposed sidewalls whereby the cross-sectional area of said transition chamber increases between said duct and said boiler, said transition chamber defined by air-tight side walls, air-tight floor and air-tight roof, said walls, floor and roof including water-cooled tubes, means rigidly uniting said tubes, said tubes being connected at their upper ends to said steam drum and at their lower ends to said steam and water drum so that said tubes extend upwardly over their entire length from said steam and water drum to said steam drum.

2. The waste heat steam boiler plant of claim 1 wherein said transition chamber further comprises spaced apart water-cooled tubes defining a screen extending across said transition chamber adjacent the connection of said transition chamber to said waste gas duct, said screen tubes having upper ends adjacent said roof and lower ends adjacent said floor, and said floor further including additional water-cooled tubes connected at one end to said steam and water drum and connected at another end to said lower ends of said screen tubes, and said roof further including additional roof tubes connected at one end to said upper ends of said screen tubes and connected at another end to said steam drum.

3. The waste heat steam boiler plant of claim 1 wherein said transition chamber further comprises extra tubes within said chamber adjacent to said roof and extending parallel to said roof, extra tubes within said chamber adjacent to said floor and extending parallel to said floor, said side walls further including additional tubes connected at their upper ends to one end of said extra roof tubes and connected at their lower ends to one end of said extra floor tubes, said extra roof tubes connected at their other end to said steam drum, and said extra floor tubes connected at their other end to said steam and water drum.

* * * * *